United States Patent [19]

Kohler et al.

[11] 4,152,562

[45] May 1, 1979

[54] DRIVING MECHANISM FOR SWITCHING APPARATUS WITH PRESSURE CONTACTS

[75] Inventors: Werner Kohler, Bentfeld; Norbert Steinemer, Berlin, both of Fed. Rep. of Germany

[73] Assignee: Siemens Aktiengesellschaft, Munich, Fed. Rep. of Germany

[21] Appl. No.: 897,350

[22] Filed: Apr. 18, 1978

[30] Foreign Application Priority Data

Apr. 20, 1977 [DE] Fed. Rep. of Germany ..... 2717958

[51] Int. Cl.[2] ..... H01H 3/38

[52] U.S. Cl. ..... 200/153 SC

[58] Field of Search ..... 200/329-332, 200/337, 153 SC, 67 DK, 74, 78, 154

[56] References Cited

U.S. PATENT DOCUMENTS

| | | | |
|---|---|---|---|
| 1,938,408 | 12/1933 | Thumin | 200/153 SC |
| 2,784,270 | 3/1957 | Nisland | 200/78 |

*Primary Examiner*—Harry N. Haroian

*Attorney, Agent, or Firm*—Kenyon & Kenyon, Reilly, Carr & Chapin

[57] ABSTRACT

A driving mechanism for use with pressure contacts wherein the mechanism is provided with a drive means for opening and closing the contacts and wherein the drive means undergoes a driving stroke in bringing the contacts to a closed position. The mechanism is further provided with a closing spring means for actuating the drive means to initiate closing of the contacts and a second spring means responsive to the aforesaid actuation of the drive means and which is cocked there during for actuating the first means to initiate opening of the contacts. In accord with the invention, a pressure spring means for applying pressure to the contacts is also provided; the latter pressure spring means being responsive to the drive means and cocked thereby during a substantial portion of the closing driving stroke.

3 Claims, 2 Drawing Figures

DRIVING MECHANISM FOR SWITCHING APPARATUS WITH PRESSURE CONTACTS

BACKGROUND OF THE INVENTION

1. Field of the Invention

The invention relates to a driving mechanism for use with the pressure contacts of an electric switching mechanism, such as a vacuum circuit breaker wherein the mechanism includes: a drive means for bringing the contacts to an open and closed position; closing and opening spring means for actuating the drive means to initiate such closing and opening, the opening spring means being cocked during actuation by the closing spring means; and a contact pressure spring for applying pressure to the contacts in the closed position.

2. Description of the Prior Art

In drive mechanisms of the aforesaid type, the motion cycle of the mechanism is required to have a duration which is definite and, in some cases, forces which have a definite dependence on the distance travelled. On the other hand, the mechanism is also required to comply with certain other constraints such as, for example, specified outline dimensions, low-impact motion and low power requirements.

Electric switching mechanisms which employ pressure contacts, such as, for example, vacuum circuit breakers and certain types of switchgear, require a contact pressure spring which, in the closed position of the switch, maintains the pressure required for the passage of the current between the contacts independently of the other springs of the above described driving mechanism. The contact pressure spring is located at a point in the drive mechanism whereat driving forces are transmitted to the pressure contacts and is pre-tensioned in correspondence to the magnitude of the minimum contact pressure required. In the closing process, this pre-tension is overcome when the pressure contacts touch each other, thereby resulting in a steep rise in the force-vs-distance curve of the driving mechanism. Subsequent to overcoming the pre-tension of the contact pressure spring, the spring is further cocked by the so-called "follow-on" stroke, so that the desired or required contact pressure is still present in case the contacts are worn or burn-off occurs.

It is customary to design the aforesaid driving mechanisms so that their motion cycles are such that the metallic contact of the pressure contacts takes place toward the end of the closing movement. As a result, the contact pressure is supplied only during a relatively small portion of the total closing motion or stroke.

It is an object of the present invention to provide an improved driving mechanism of the aforesaid type.

SUMMARY OF THE INVENTION

The above and other objects are realized in accordance with the principles of the present invention in a driving mechanism of the above-described type by further providing that the contact spring be cocked by the drive means of the mechanism during a substantial portion of the driving stroke carried out in bringing the pressure contacts to a closed position.

With the driving mechanism so designed, use thereof in breakers with relatively low closing power provides a substantial advantage in that the closing spring is now required to have only a relatively small amount of excess power for driving the drive means in cocking the contact pressure spring. This means not only that the size of the closing spring can be reduced, but also, that the switching apparatus as a whole will be under less stress during closing. Additionally, other things, auxiliary devices such as auxiliary switches and pushbuttons, are also protected because of the resulting more gentle motion cycle. This has a beneficial effect on the reliability of the switching mechanism whose contacts are being driven.

The driving mechanism of the present invention is thus especially suitable for driving the contacts of vacuum circuit breakers, which require very little closing energy. However, even in these circuit breakers up until now strong closing springs have been used so that the contact pressure spring could be cocked at the end of the closing process.

In one embodiment of the present invention, the drive means includes a crank arm mounted on the breaker shaft and the effective lever arm of which is approximately zero in the fully closed position of the contacts. In this embodiment, the parts required for latching the driving mechanism in the "on" position are stressed only by the relatively small force of the opening spring. Thus, the latching mechanism can be relatively simple as opposed to the elaborate and complex latching mechanisms required with increasing forces. Moreover, current forces and the contact pressure spring do not generate a torque at the breaker shaft. No difficulties are encountered, on the other hand, in taking up the spring forces in the bearings of the breaker shaft. Additionally, the opening spring needs to supply only a relatively small force because it must only move the crank arm with the breaker shaft out of its dead center position, and subsequently, the cocked contact pressure spring causes a strong accelerating force as the effective lever arm becomes larger. Thereafter, the opening spring needs to counteract only the forces exerted on the contacts of the vacuum breaker by the external air pressure. With the present drive mechanism, the contacts of the breaker are thus opened suddenly, as is required in vacuum circuit breakers.

It has also been found advantageous in the aforesaid embodiment of the drive mechanism of the invention to cause metallic contact of the pressure contacts during opening at a switching angle or rotation of the drive means which is about 30° ahead of the position of the drive means at which the crank arm is at its end position and to cause the entire switching angle or rotation to be about 60°.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
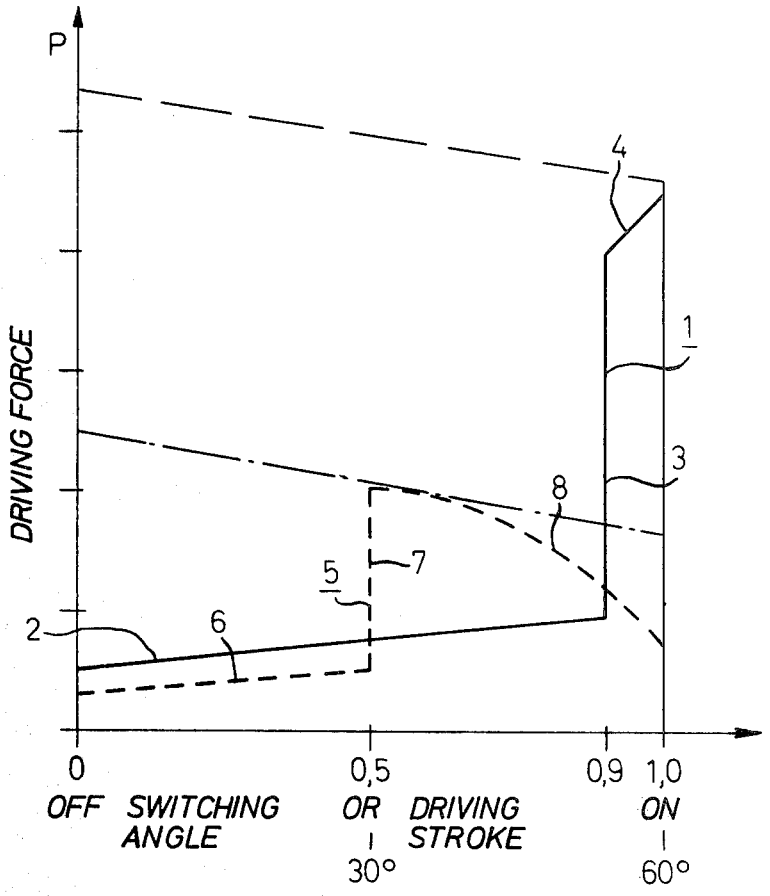
FIG. 1 illustrates a plot of the force-vs-distance curves of a driving mechanism in accordance with the invention and of a conventional driving mechanism.

FIG. 1 illustrates plots 1 and 2, respectively, of the driving force versus the switching angle or the stroke of a conventional driving mechanism and a driving mechanism in accordance with the invention. The left hand border of the diagram corresponds to the off or open position and the righthand border to the on or closed position of the breaker contacts being driven by the mechanism. As can be seen, the plotted characteristic 1 has three sections. A first section 2 is slowly increasing and corresponds to the characteristic of the the opening spring, while section 3 rises instantaneously and corresponds to when the pre-tension force on the contact pressure spring is overcome. Section 4 rises with a slope to the end of the closing motion in accordance with the characteristic of the contact pressure spring. It is important to note that the characteristic 1 shows that in the conventional driving mechanism the pre-tension force on the contact pressure spring is overcome at a point which is about 0.9 of the total driving distance or stroke.

Characteristic 5 likewise has a slowly rising initial section designated 6. However, in this case, as evidenced by the section marked 7, the point at which the pre-tension force of the contact pressure spring is overcome occurs much earlier in the driving stroke and, as shown, at about 0.5 of the total stroke. Thereafter, as evidenced by the section designated 8, the force decreases and drops uniformly to a low value.

The characteristics 1 and 5 are also shown to bound equal areas and, therefore, indicate that the work capacity of the two driving mechanisms is equal. In spite of this, the maximum occurring force which must be overcome by the closing spring (dash-dotted line in FIG. 1) is substantially lower for the driving mechanism of the present invention than for the conventional driving mechanism.

Figure 2:
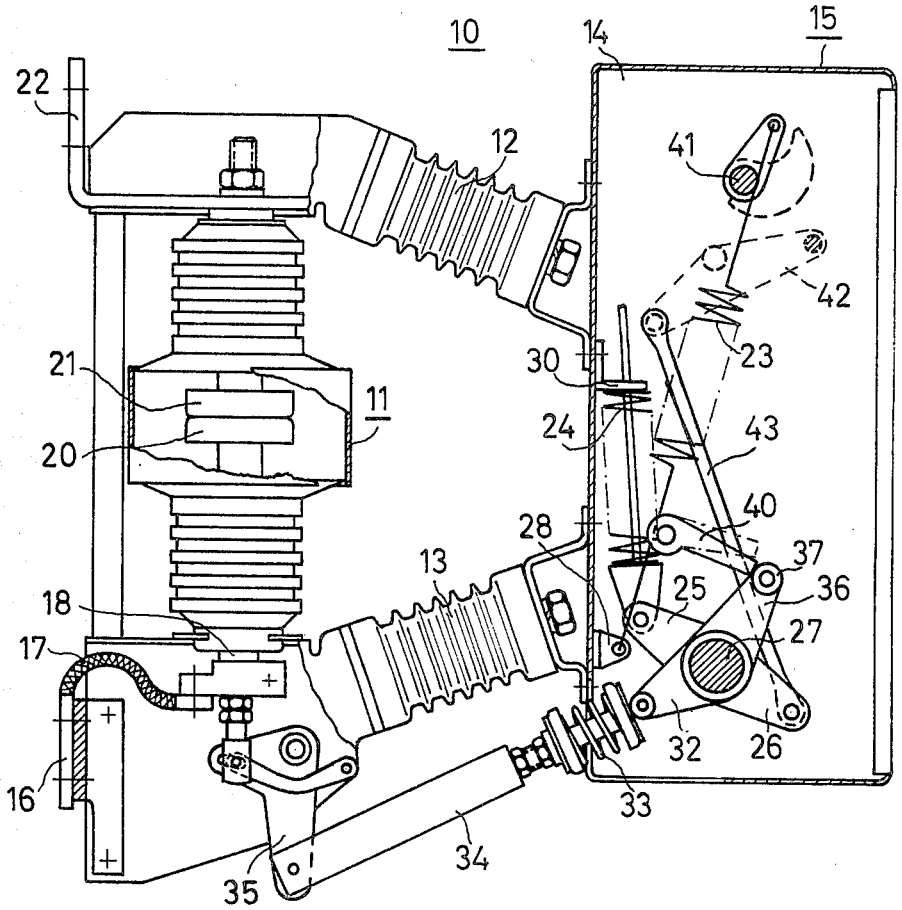
FIG. 2 illustrates a driving mechanism in accordance with the principles of the present invention.

FIG. 2 shows a physical emobdiment of the driving mechanism of the present invention. As shown, the driving mechanism 15 is to operate the pressure contacts of a vacuum circuit breaker 10 comprising a switching vessel 11 which is fastened by means of standoff insulators 12 and 13 to the housing 14 of a driving mechanism 15. The current path of the vacuum circuit breaker 10 extends from a lower terminal 16 via a flexible current-carrying ribbon 17 to a plunger 18 which operates a movable contact 20 in the interior of the vacuum switching vessel 11. The current path extends from the contact 20 to a fixed contact 21 and therefrom continues to an upper terminal 22.

Disposed in the housing 15 is a closing spring 23 as well as an opening spring 24. The closing spring 23 is suspended by one of its ends from a stationary eye 28 and engages with its other end a cocking shaft 41. The latter shaft can be actuated in any suitable conventional manner. By likewise conventional means which need not be explained in connection with the present invention, the closing spring 23 actuates through a coupler link 43, a lever arm 26 of a breaker shaft 27. The opening spring 24 is, in turn, braced against an abutment 30 connected to the housing wall and engages a further lever 25 of the breaker shaft 27.

The breaker shaft 27 carries two further levers 32 and 36. The lever 32 is connected as a crank arm, via a contact pressure spring 33, an insulating connecting rod 34 and an angle lever 35, to the plunger 18 of the vacuum switching vessel 11. The other lever 36 carries at its end a roller 37 which cooperates with a latching lever 40 within the housing 14.

In operation, to close the vacuum breaker 10, the closing spring 23 is first cocked by rotating the cocking shaft 41 via a suitable device (not shown), e.g., a motor drive unit or a hand lever. This latter device can be conventionally designed such that the closing spring 23 is latched in the cocked condition, thereby holding the stored energy of the spring in readiness for use at any desired instant. Upon the release of the cocked closing spring by a suitable closing command, swivel lever 42, indicated schematically in the drawing, is actuated. The lever 42, in turn, via the link 43 as well as the lever arm 26, causes the breaker shaft 27 to be actuated or rotated. In the course of the total closing process or stroke, the breaker shaft 27 is rotated through an angle of rotation of about 60°. After above 30° of this rotation, the contacts 20 and 21 come into contact with each other. Upon further rotation, the contact pressure spring 33 is cocked until the lever 32 and the angle lever 35 occupy the position shown in FIG. 2. The lever 32 is thus now in the dead center position relative to the breaker shaft 27, so that the effective lever arm relative thereto is approximately zero. In this position, the latching lever 40 rests against the roller 27 and keeps the drive mechanism and, hence, the breaker contacts locked in the closed position. Also, at this time, the forces on the latching lever 40 are quite small.

To now open the vacuum breaker, the latching lever 40 is disengaged from the roller 37 as, for example, by hand or by an electromagnetic tripping device. The energy stored in the opening spring 24 during the opening process now acts on the lever arm 25 and rotates the breaker shaft 27 and, hence, the lever 32 mounted thereon out of the dead center position relative thereto. As soon as this occurs, the energy stored in the contact pressure spring 33 also acts on the breaker shaft 27, thereby causing an acceleration of the shaft in the direction of the opening motion. As a result, the breaker shaft 27 moves with considerable velocity during this portion of the closing stroke; this rapid movement of the shaft being evidenced by the jump in the characteristic 5 of FIG. 1 occurring at 0.5 of the total stroke or 30° of rotation of the shaft 27. The contacts 20 and 21 of the vacuum switching vessel are consequently separated as if they were struck by a blow thereby ensuring that any welds that may have occurred are torn open. Subsequent movement of the shaft 27 during the remainder of the opening stroke is aided by the opening spring 24.

What is claimed is:

1. A driving mechanism for use with the pressure contacts of a switching mechanism comprising:

drive means for opening and closing said contacts, said drive means undergoing a driving stroke during the closing of said contacts;

closing spring means for actuating said drive means so as to cause closing of said contacts;

opening spring means responsive to said actuation of said drive means and being cocked thereduring for actuating said drive means so as to cause opening of said contacts;

pressure spring means for applying pressure to said contacts, said pressure spring means being responsive to said drive means and being cocked thereby during a substantial portion of said driving stroke.

2. A drive mechanism in accordance with claim 1 wherein a shaft is connected to a movable one of said contacts and wherein:

said drive means includes a crank arm mounted on said shaft whose effective lever arm is approximately zero at the end of said stroke.

3. A drive mechanism in accordance with claim 2 wherein:

said contacts are brought into metallic contact at a switching angle of 30° ahead of the end position of said crank arm and the total switching angle corresponding to said stroke is approximately 60°.

* * * * *